United States Patent [19]

Kilian

[11] 3,954,661

[45] May 4, 1976

[54] CALCINATION PROCESS FOR RADIOACTIVE WASTES

[75] Inventor: Douglas C. Kilian, Kennewick, Wash.

[73] Assignee: The United States of America as represented by the United States Energy Research and Development Administration, Washington, D.C.

[22] Filed: Sept. 10, 1974

[21] Appl. No.: 504,789

[52] U.S. Cl. ..... 252/301.1 W

[51] Int. Cl.[2] ..... G21F 9/14

[58] Field of Search ..... 252/301.1 W, 301.1 R

[56] References Cited

UNITED STATES PATENTS 3,479,295 11/1969 Thompson ..... 252/301.1 W 3,781,217 12/1973 Newby et al. ..... 252/301.1 W

*Primary Examiner*—Benjamin R. Padgett
*Assistant Examiner*—Deborah L. Kyle
*Attorney, Agent, or Firm*—Dean E. Carlson; Arthur A. Churm; Robert J. Fisher

[57] ABSTRACT

The present invention provides a method for minimizing the volatilization of chlorides during solidification in a fluidized-bed calciner of liquids containing sodium, nitrate and chloride ions. Zirconium and fluoride are introduced into the liquid, and one-half mole of calcium nitrate is added per mole of fluoride present in the liquid mixture. The mixture is calcined in the fluidized-bed calciner at about 500°C., producing a high bulk density calcine product containing the chloride, thus tying up the chloride in the solid product and minimizing chloride volatilization.

5 Claims, No Drawings

CALCINATION PROCESS FOR RADIOACTIVE WASTES

CONTRACTUAL ORIGIN OF THE INVENTION

The invention described herein was made in the course of, or under, a contract with the UNITED STATES ATOMIC ENERGY COMMISSION.

BACKGROUND OF THE INVENTION

This invention relates to the solidification of liquids containing sodium, nitrate and chloride ions by calcining the liquid in a fluidized-bed calciner. More particularly, the invention relates to the solidification of liquid radioactive wastes for long-term storage as a solid. Specifically, the invention is directed towards minimizing the volatilization of the chlorides present in the liquid during the solidification process.

Liquid radioactive wastes produced during the reprocessing of spent nuclear reactor fuel elements to recover the unburned nuclear fuel material are more conveniently, safely and economically stored for long periods of time as a solid. Consequently, methods have been sought for converting the liquid radioactive waste to solids for long-term storage. One technique which has proven to be particularly adaptable to the solidification of liquid radioactive waste is calcination in a fluidized-bed calciner. Such a fluidized-bed calciner has been successfully operated for a significant period of time at the Waste Calcining Facility of the Idaho Chemical Processing Plant (ICPP) located at the National Reactor Testing Station in southeastern Idaho.

While several types of liquid radioactive waste have been readily calcined and techniques have been developed to permit the calcining of other types of waste in the fluidized-bed calciner, each type of waste gives rise to unique and characteristic problems and special considerations which stem from the particular composition of the waste. Differences in the composition of the various types of waste arise from the various process steps for the recovery of the fuel in which the waste is generated and the various types of fuel and cladding introduced at the head-end of the fuel recovery process.

A typical problem which arises in the fluidized-bed calcining of the many types of waste is the fouling of the fluidized bed by particle agglomeration due to the presence of sodium nitrate. Sodium nitrate does not decompose but melts and exists in a molten state between 305°C. and 833°C. which includes the normal range of calcination temperatures. Therefore it is present in a molten state and can cause agglomeration of the bed particles and consequent fouling of the fluidized bed.

Volatilization of various corrosive components, such as fluorides and chlorides, presents problems downstream from the fluidized bed in the off-gas cleanup system. Consequently, it is desirable to minimize fluoride and chloride volatility. One type of liquid radioactive waste which presents both the problem of fluidized-bed particle agglomeration and chloride corrosion problems is ICPP intermediate-level waste, which is described in more detail below. Approximately 850,000 gallons of intermediate-level radioactive waste are stored in underground storage tanks at the Idaho Chemical Processing Plant. This waste must be solidified in the future to meet with AEC waste-storage specifications and to make room for additional waste generated at the ICPP.

It is an object of the present invention to provide a calcination process for this intermediate-level waste.

It is another object of the present invention to provide a calcination process for the fluidized-bed calcining of the intermediate-level waste in which bed particle agglomeration will not be a problem.

An additional object of the present invention is to provide a method for the fluidized-bed calcining of intermediate-level waste in which the volatilization of chlorides will be minimized.

SUMMARY OF THE INVENTION

In accordance with the present invention, liquids containing sodium, nitrate, and chloride ions are calcined to solids in a fluidized-bed calciner while minimizing volatilization of chlorides and preventing agglomeration of the bed particles by molten sodium nitrate. Zirconium and fluoride are introduced into the liquid containing the sodium, nitrate, and chloride ions and ½ mole of calcium nitrate per mole of fluoride present in the liquid mixture is added. The combined mixture is then calcined in a fluidized-bed calciner at about 500°C., resulting in a high bulk density calcine product containing the chloride and thus minimizing the chloride volatilization. In a specific embodiment of the present invention, intermediate-level liquid radioactive wastes are combined with zirconium fluoride radioactive waste and ½ mole calcium nitrate per mole of fluoride present is added to the combined mixture. Preferably, 3 parts zirconium fluoride waste are blended with 1 part intermediate-level waste.

DESCRIPTION OF THE INVENTION

While the invention will be described in connection with a specific embodiment, it should be understood that it is not intended to limit the invention to that specific embodiment. On the contrary, it is intended to cover all alternatives, modifications and equivalents as may be included within the spirit and scope of the invention as defined by the appended claims.

Solidification by fluidized-bed calcining of a liquid which contains sodium, nitrate and chloride ions presents two serious problems. Firstly, the presence of sodium and nitrate in the liquid can cause problems in fouling the fluidized bed. Sodium nitrate does not decompose at the temperatures generally used in the fluidized bed but does melt well below the calcination temperature. Molten sodium nitrate in the bed causes the bed particles to agglomerate, with the resulting fouling of the bed. Secondly, the chloride present can volatilize during the calcination process, accumulate in the wet off-gas scrubbing system and cause corrosion problems downstream from the fluidized bed.

A specific type of liquid containing these ions is ICPP intermediate-level radioactive waste. Intermediate-level waste is a name given to ICPP liquid waste generated primarily from the second and third cycle extraction process solutions used in the recovery of fissile material during the reprocessing of nuclear fuel elements. Average composition and the origin of some of the species contained in ICPP intermediate-level waste are indicated in Table I below.

TABLE I

COMPOSITION AND ORIGIN OF ICPP INTERMEDIATE-LEVEL WASTE

| Chemical Species | Concentration (M) | Origin |
|---|---|---|
| $Al^{+3}$ | 0.52 | 2nd- and 3rd-cycle extraction [$Al(NO_3)_3$] |
| $B^{+3}$ | 0.01 | Soluble poison |
| $Cl^-$ | 0.05 | Basin water, impurity in raw chemicals |
| $Fe^{+3}$ | 0.02 | 2nd-cycle extraction ($Fe^{++}$ for $Pu^{+5}$) |
| $H^+$ | 1.06 | Decontamination solution, extraction |
| $K^+$ | 0.20 | Decontamination solution |
| $Na^+$ | 1.90 | Decontamination solution, 1st-cycle extraction ($NaCO_3$) |
| $NO_3^-$ | 4.61 | Extraction |
| $F^-$ | — | |

The concentrations listed in Table I are average contrations and it should be understood that the concentrations of any one specie may vary by 10% above or below that concentration listed in the table. The important consideration is that the intermediate-level waste contain considerable amounts of sodium and nitrate ion and a significant chloride concentration.

It has been found that introduction into these liquids of zirconium and fluoride ions followed by the addition of calcium nitrate will permit calcining of the mixture at normal calcination temperatures without fluidized-bed agglomeration. A high bulk density calcine product containing the chloride is produced, thus minimizing chloride volatilization as well as fluoride volatilization. A convenient source of zirconium and fluoride ion is ICPP zirconium fluoride liquid radioactive waste produced during the reprocessing of zirconium-clad nuclear fuel elements. Table II below shows typical concentrations of chemical species contained in ICPP zirconium fluoride wastes.

TABLE II

COMPOSITION OF ICPP ZIRCONIUM FLUORIDE WASTE

| Chemical Species | Concentration (M) |
|---|---|
| $Al^{+3}$ | 0.67 |
| B | 0.20 |
| $Cl^-$ | — |
| $Fe^{+3}$ | 0.005 |
| $F^-$ | 3.21 |
| $H^+$ | 1.60 |
| $NO_3^-$ | 2.36 |
| Zr | 0.45 |

The concentrations in Table II are average concentrations and the concentration of any specie typically would vary 10% above or below that listed in the table.

In accordance with the method of the present invention, 1 volume of intermediate-level waste was blended with from 2 to 5 volumes of zirconium fluoride waste and ½ mole of calcium nitrate per mole of fluoride in the solutions was added prior to calcination. The mixed liquids were then calcined at about 500°C. A particulate product containing the chloride was produced by this process with no problem of bed agglomeration. This product had a bulk density of about 1.8 grams per cubic centimeter. The density and attrition resistance of this product was comparable or better than other calcined materials produced at the ICPP. High bulk density is desirable for minimizing the volume of solid waste to be stored. Attrition resistance is important, as finely divided calcined product elutriated from the calciner vessel will dissolve in the off-gas scrubbing solution, releasing chloride ion to the system. This will result in corrosion of the off-gas treatment system. However, because this product is highly resistant to attrition, relatively few fines are generated and the chloride concentration in the scrub solution of the off-gas cleanup system remains acceptably low. Typical values have been 500 parts per million. Fluoride volatility likewise has not been a problem with the present method.

While the fluidized-bed calcination is generally conducted at 500°C., temperature variations were tested to determine whether or not there was a range of preferred values. While runs conducted at 450°C. and at 550°C. have proven to be not as satisfactory as the preferred operating temperature of 500°C., an operation range of 475° to 525°C. is acceptable. The temperature variation has been found to play a role, as the amount of chloride retained in the product has been found to be sensitive to the calcination temperature. 500°C. has proven to be optimal and is therefore preferred.

It has also been found that product bulk density and attrition resistance is affected by the blend ratio of intermediate-level waste to zirconium fluoride waste. It is believed that the ratio determines the total sodium contained in the product and the ratio therefore plays an important role. As stated above, a ratio of 1 volume of intermediate-level waste combined with from 2 to 5 volumes of zirconium fluoride waste has been found to give acceptable results. Preferably, the ratio is 1 part intermediate-level waste to 3 parts of zirconium fluoride waste.

The calcium added in the form of calcium nitrate plays an important role as it serves to minimize fluoride volatility. Therefore, the ratio of calcium to fluoride should not be varied significantly from 1:2. Since calcium is not present in the solutions until the $Ca(NO_3)_2$ is added, the amount of calcium present in the mixture is easily controlled. Since fluoride is not present in intermediate-level waste, the amount of calcium added is dependent upon the amount of fluoride introduced with the zirconium fluoride waste.

While the invention has been described in terms of the specific embodiment and with reference to specific types of radioactive waste, the invention should not be limited to these specific wastes or wastes from similar sources. Rather the invention is equally applicable to other solutions containing the chemical species of concern in similar concentrations.

The embodiments of the invention in which an exclusive property or privilege is claimed are defined as follows:

1. A method for minimizing the volatilization of chlorides during the solidification of liquid intermediate-level radioactive waste by calcining the liquid waste in a fluidized-bed calciner comprising:

blending from 2 to 5 parts zirconium fluoride wastes with 1 part intermediate-level wastes;

adding about one-half mole of calcium nitrate per mole of fluoride present in the liquid solution; and calcining the mixture whereby a high bulk density calcine product containing chloride is produced, thus tying up the chloride and minimizing volatilization of the chloride.

2. The method in accordance with claim 1 wherein said mixture is calcined at a temperature between 475°C. and 525°C.

3. The method in accordance with claim 2 wherein 3 parts zirconium fluoride wastes are blended with 1 part intermediate-level waste.

4. The method of minimizing the volatilization of chlorides in accordance with claim 3 wherein said mixture is calcined at about 500°C. to produce a high bulk density calcine product containing the chloride.

5. In the method of converting liquid radioactive wastes to solids for long-term storage by calcining said liquid radioactive wastes in a fluidized-bed calciner, where said liquid radioactive wastes are intermediate-level wastes containing significant concentrations of sodium ion, nitrate ion and chloride ion, the improvement therein comprising:

a. blending one part of said intermediate-level wastes with from 2 to 5 parts zirconium fluoride wastes;

b. adding one-half mole of calcium nitrate per mole of fluoride present; and c. calcining the mixture at about 500°C. whereby a high bulk density calcine product containing chloride is produced and volatilization of chloride is minimized.

* * * * *